US011976416B2

(12) United States Patent
Mikulic

(10) Patent No.: US 11,976,416 B2
(45) Date of Patent: May 7, 2024

(54) CONTINUOUS PROCESS FOR PRODUCTION OF CELLULOSE PULP FROM GRASS-LIKE FEEDSTOCK

(71) Applicant: Marinko Mikulic, Zagreb (HR)

(72) Inventor: Marinko Mikulic, Zagreb (HR)

(73) Assignee: Marinko Mikulic, Zagreb (HR)

( * ) Notice: Subject to any disclaimer, the term of this patent is extended or adjusted under 35 U.S.C. 154(b) by 359 days.

(21) Appl. No.: 17/386,557

(22) Filed: Jul. 28, 2021

(65) Prior Publication Data

US 2021/0355636 A1 Nov. 18, 2021

Related U.S. Application Data

(63) Continuation of application No. PCT/EP2020/051957, filed on Jan. 27, 2020.

(30) Foreign Application Priority Data

Feb. 7, 2019 (HR) ..... P20190259A

(51) Int. Cl.
*D21C 11/00* (2006.01)
*D21C 3/02* (2006.01)
(Continued)

(52) U.S. Cl.
CPC ..... *D21C 11/0078* (2013.01); *D21C 3/02* (2013.01); *D21C 9/007* (2013.01); *D21C 9/10* (2013.01);
(Continued)

(58) Field of Classification Search
CPC ..... D21C 11/0078; D21C 3/02; D21C 9/007; D21C 9/10; D21C 9/18; D21C 11/0007;
(Continued)

(56) References Cited

U.S. PATENT DOCUMENTS 2,903,326 A 9/1959 Heitman
4,421,598 A 12/1983 Reeve
(Continued)

FOREIGN PATENT DOCUMENTS

CA 2038651 C 12/1995
GB 655056 A 7/1951
(Continued)

OTHER PUBLICATIONS

Cappelletto et al., "Papermaking Pulps From the Fibrous Fraction of Miscanthus x Giganteus", Industrial Crops and Products, vol. 11, 2000, pp. 205-210.
(Continued)

*Primary Examiner* — Eric Hug
*Assistant Examiner* — Matthew M Eslami
(74) *Attorney, Agent, or Firm* — XSENSUS LLP

(57) ABSTRACT

An improved continuous process for production of cellulose from glass-like feedstock, which includes:

(i) cooking of comminuted grass-like feedstock in white liquor which contains 0.5-2.0% w/w NaOH and 0.5-25.0% w/w NaCl at 95-100° C.;

(ii) bleaching process of the brown cellulose in the white liquor of the same composition with oxygen ($O_2$) and chlorine ($Cl_2$) at 70-100° C., yielding bleached cellulose pulp; where, (iii) lignin and other side-products are separated by continuous electrolysis, where the white liquor is regenerated, together with $O_2$ and $Cl_2$ for the bleaching purpose, thereby closing the cycle of the process.

20 Claims, 3 Drawing Sheets

(51) Int. Cl.

| | |
|---|---|
| ***D21C 9/00*** | (2006.01) |
| ***D21C 9/10*** | (2006.01) |
| ***D21C 9/18*** | (2006.01) |
| ***D21C 11/04*** | (2006.01) |
| ***D21H 11/12*** | (2006.01) |

(52) U.S. Cl.
CPC ..... *D21C 9/18* (2013.01); *D21C 11/0007* (2013.01); *D21C 11/04* (2013.01); *D21H 11/12* (2013.01)

(58) Field of Classification Search
CPC ..... D21C 11/04; D21C 5/00; D21C 9/147; D21C 11/0042; D21H 11/12
See application file for complete search history.

(56) References Cited

U.S. PATENT DOCUMENTS

| | | | |
|---|---|---|---|
| 4,584,076 | A | 4/1986 | Edel et al. |
| 5,061,343 | A | 10/1991 | Azarniouch et al. |
| 5,366,714 | A | 11/1994 | Bigauskas |
| 2006/0201642 | A1 | 9/2006 | Shin et al. |

FOREIGN PATENT DOCUMENTS

| | | | | |
|---|---|---|---|---|
| GB | 681661 | A | 10/1952 | |
| GB | 770687 | A | 3/1957 | |
| WO | 94/12720 | A1 | 6/1994 | |
| WO | 01/38607 | A1 | 5/2001 | |
| WO | 2017/178849 | A1 | 10/2017 | |
| WO | WO-2017178849 | A1 * | 10/2017 | ..... D21C 11/0007 |

OTHER PUBLICATIONS

Zhu et al., "Microwave Assisted Chemical Pretreatment of Miscanthus Under Different Temperature Regimes", Sustainable Chemical Process, vol. 3, No. 15, 2015, pp. 1-13.

Law et al., "Characteristics of Peroxide Bleaching of Microwave-Heated Thermomechanical Pulps", Journal of Pulp and Paper Science, vol. 19, No. 5, Sep. 1993, pp. J181-J186.

Ververis et al., "Fiber Dimensions, Lignin and Cellulose Content of Various Plant Materials and Their Suitability for Paper Production", Industrial Crops and Products, vol. 19, 2004, pp. 245-254.

Godin et al., "Determination De La Cellulose, Des Hémicelluloses, De La Lignine Et Des Cendres Dans Diverses Cultureslignocellulosiques Dédiées À La Production De Bioéthanol De Deuxième Génération", Biotechnologie, Agronomie, Société et Environnement/Biotechnology, Agronomy, Society and Environment, vol. 14, 2010, 7 pages. English Abstract included.

International Search Report and Written Opinion dated May 7, 2020, received for PCT Application PCT/EP2020/051957, Filed on Jan. 27, 2020, 13 pages.

* cited by examiner

CONTINUOUS PROCESS FOR PRODUCTION OF CELLULOSE PULP FROM GRASS-LIKE FEEDSTOCK

CROSS-REFERENCE TO RELATED APPLICATIONS

This application is a continuation of International App. No. PCT/EP2020/051957 filed Jan. 27, 2020, which claims the benefit of priority to Croatian (HR) Patent App. No. P20190259A filed Feb. 7, 2019, wherein the entire contents and disclosure of each of the foregoing applications is incorporated by reference herein in its entirety.

TECHNICAL FIELD

The present disclosure relates to an improved process for production of cellulose pulp for paper manufacturing from grass-like feedstock such as dried plant mass of leaves and/or stems of sorghum (*Sorghum* species L.) or maize (*Zea mays* L.).

TECHNICAL PROBLEM

A technical problem to be solved by the present disclosure is effective production of high-quality cellulose for paper manufacturing from grass-like feedstock such as sorghum (*Sorghum* species L.), which includes efficient solving of the following technological details:

(i) cooking the grass-like feedstock under mild reaction conditions in order to maximally preserve native cellulose fibres, with lignin and other side-products removal by their dissolving in the solution of digesting chemicals;

(ii) bleaching brown cellulose; with such solution of bleaching chemicals that enables effective bleaching under, as mild as possible, reaction conditions for preservation of cellulose fibres; and, (iii) effective regeneration of black liquor from the cooking phase and waste waters from the bleaching phase, what provides minimal chemicals consumption and therefore minimal ecological footprint.

The cooking phase is additionally improved by the use of freshly prepared or electrolytically regenerated white liquor, which minimally contains sodium hydroxide (NaOH; 0.5-2.0% w/w) and sodium chloride (NaCl; 0.5-2.0% w/w).

According to our best knowledge, the present disclosure represents the first continuous process for cellulose production which includes:

(i) ecologically-acceptable bleaching technology with electrochemically generated oxygen ($O_2$) and chlorine ($Cl_2$) in the presence of sodium hydroxide (NaOH) and sodium chloride (NaCl);

(ii) almost 100% regeneration of all chemicals in the process;

(iii) effective electrolytic lignin and other non-cellulosic side-products isolation from black liquor of the cooking phase and from waste waters from the bleaching phase; and, (iv) conditions which entirely meet common criteria for environmentally-friendly technology.

PREVIOUS STATE OF THE ART

Cellulose pulp production for paper manufacturing from renewable, fast-growing and economical feedstock is of a great importance for the modern paper industry. Classical processes which are based on wood as the starting feedstock are more and more substituted by technologies that rely on grass-like feedstock such as *miscanthus* (*Miscanthus* x *giganteus*, Andersson), sorghum (*Sorghum* species, Linne), straw from various cereals, etc.; see for instance literature reference 1:

1) C. Cappelletto, F. Mongardini, B. Barberi, M. Sannibale, M. Brizzi, V. Pignatelli: Papermaking pulps from the fibrous fraction of *Miscanthus* x *Giganteus, Ind. Crops Prod.* 11 (2000) 205-210.

In the cellulose pulp production processes, the most important is the cooking/digesting phase. It includes the cooking of comminuted lignocellulosic material with aqueous solution of suitable chemicals. A larger number of different processes for cooking lignocellulosic materials is known, which are usually divided by the sort of chemicals that are employed in the process. The most known technologies are based on the following digesting solutions:

(i) sulphur-based: sodium carbonate ($Na_2CO_3$) and sodium sulphite ($Na_2SO_3$); magnesium hydroxide [$Mg(OH)_2$] and magnesium sulphite ($MgSO_3$); ammonium hydroxide ($NH_4OH$) and ammonium sulphite [$(NH_4)_2SO_3$]; calcium hydrogensulphite [$Ca(HSO_3)_2$]; magnesium hydrogensulphite [$Mg(HSO_3)_2$]; sodium hydroxide (NaOH), sodium sulphide ($Na_2S$) and sodium sulfate ($Na_2SO_4$);

(ii) without sulphur: sodium carbonate ($Na_2CO_3$); sodium hydroxide (NaOH); and, (iii) based on acids such as nitric acid ($HNO_3$).

The cooking chemicals solution is commonly called "white liquor" and represents a freshly prepared or regenerated solution of chemicals for digesting lignocellulosic material. The white liquor helps to remove non-cellulosic material by converting them into the solution, while relatively pure cellulose fibres remain suspended in this liquid phase. Such cellulose suspension is known as cellulose pulp.

The above-mentioned liquid phase (supernatant), in which cellulose fibres are suspended after the digesting phase, is called "black liquor", and contains dissolved non-cellulosic components of the starting lignocellulose feedstock and excess of cooking chemicals. Therefore, the cooking process product is a suspension of brown cellulose fibres in the black liquor.

Regarding the type of chemistry that is employed in the cooking (digesting) process, all technologies that do not use sulphur-based chemicals have significant advantage from both process and ecological reasons. Technologies without sulphur chemicals preserve process equipment from corrosion, and environment from unnecessary pollution, and are essentially without significant negative environmental footprint.

One of the most important processes which is considered as environmentally-friendly is based on sodium hydroxide (NaOH) as a key chemical for preparation of the white liquor. The use of NaOH as the sole chemical for digesting lignocellulose materials is known in the art. One of typical processes is based on the use of 5% w/w aqueous NaOH solution, which is employed as the white liquor for cooking grass-like feedstock at 90° C. during several hours; see literature reference 2:

2) GB 770,687; Method of producing cellulose; applicant: Aschaffenburger Zellstoffwerke (DE).

The cooking phase can be carried out by the use of microwave (MW) for heating of lignocellulose material suspension in the white liquor. For instance, Zhu and co-workers described a process for pre-treatment of *miscanthus* (*Miscanthus* x *giganteus*, Andersson) with aqueous NaOH solution at very high temperatures (130-200° C.), at elevated pressure, for 20 minutes, with heating by MW. Thus, pre-treated *miscanthus* gave significantly higher yield in the sulphuric acid ($H_2SO_4$)-catalysed hydrolysis to glucose, which was subsequently employed as a starting raw material for manufacturing of bioethanol by fermentation; see literature reference 3:

3) Z. Zhu, D. J. Macquarrie, R. Simister, L. D. Gomez, S. J. McQueen-Mason: Microwave assisted chemical pre-treatment of *Miscanthus* under different temperature regimes, *Sustain. Chem. Process* 3 (2015) DOI: 10.1186/s40508-015-0041-6.

Although this process is focused on glucose production from *miscanthus*, described pre-treatment suggests potential possibility to use MW for cooking *miscanthus* and other grass-like feedstock in the cellulose pulp production. Of course, the reaction conditions described in the literature reference 3 are very harsh and clearly not compatible with manufacturing of high-quality cellulose fibres.

Beside the cooking process, another important phase in the production of high-quality cellulose pulp is the bleaching process. The most known systems for cellulose bleaching are based on the use of chlorine-based chemicals such as sodium hypochlorite (NaOCl), chlorine ($Cl_2$) in the presence of NaOH, chlorine dioxide ($ClO_2$), or hydrogen peroxide ($H_2O_2$). The use of $H_2O_2$ is being preferred.

For example, U.S. Pat. No. 2,903,326 describes the process for bleaching cellulose pulp with chlorine ($Cl_2$), sodium hypochlorite (NaOCl) or calcium hypochlorite [$Ca(OCl)_2$] and sodium hydroxide (NaOH) with addition of sodium chlorate ($NaClO_3$) at pH 2-7, preferably at pH 5-7, at temperature from 0-50° C.; see literature reference 4:

4) U.S. Pat. No. 2,903,326; J. B. Heitman: Improved process for bleaching cellulose pulp using chlorate; applicant: Pennsalt Chemicals Corporation (US).

Although from the ecological reasons the $H_2O_2$ application is preferred, some oxidants that are formally chlorine-based, are also acceptable. These do not lead to the formation of chlorinated organic compounds such as chloroform, which are unwanted environmental pollutants. The example is chlorine dioxide ($ClO_2$) which is successfully used as an oxidant for cellulose pulp bleaching. $ClO_2$ is usually separately prepared by the reaction of: sodium chlorite ($NaClO_2$) and hydrogen peroxide ($H_2O_2$); then from sodium chlorate ($NaClO_3$) and hydrogen peroxide ($H_2O_2$) in the presence of sulphuric acid ($H_2SO_4$); or by other methods; for instance, see literature references 5 and 6:

5) GB 655,056; Improvements in method for repressing the generation of chlorine dioxide; applicant: Tennants Consolidated Ltd (GB);

6) U.S. Pat. No. 5,366,714; T. D. Bigauskas: Hydrogen peroxide-based chlorine dioxide process; applicant: Sterling Canada Inc. (CA).

The cellulose pulp bleaching processes with chlorine dioxide ($ClO_2$), with or without additional oxidants, are known in the art; for example, see literature references 7 and 8:

7) US 2006201642 A1; N. H. Shin, P. J. O'Leary, O. Pikka: Methods of treating chemical cellulose pulp; applicant: Andritz Inc. (US)

8) U.S. Pat. No. 4,421,598; D. W. Reeve: Bleaching procedure using chlorine dioxide and chlorine solutions; applicant: Ergo Industries Ltd (CA).

As an example of hydrogen peroxide ($H_2O_2$)-based bleaching process, herein is outlined the document no. 9)—GB 681661, which discloses the use of the following bleaching system:

(a) 0.30-1.75% w/w $H_2O_2$;

(b) 0.75-3.25% w/w NaOH;

(c) 20-65% w/w cellulose pulp (calculated on dry matter); and (d) up to 100% w/w process water;

where the bleaching is performed at temperature below 54.4° C. Optionally, the solution of sodium silicate ($xNa_2O{\bullet}ySiO_2$) can be employed as a stabilizer for hydrogen peroxide; see literature reference 9:

9) GB 681661 A; Treatment of Chemical Pulp; applicant: Buffalo Electro-Chemical Co., Inc. (US).

This document suggests the use of a combination of hydrogen peroxide ($H_2O_2$) and sodium hydroxide (NaOH) as cellulose pulp bleaching system under relatively mild reaction conditions, below 54.4° C.

Apart from conventional heating of the bleaching reactor for cellulose pulp, the use of microwave (MW) in this phase of cellulose processing is known in the art; see literature reference 10:

10) CA 2038651 A1; K.-N. Law: Method and apparatus for bleaching pulps; applicant: K.-N. Law, J. L. Valade (US).

Moreover, Law and co-workers disclosed the method for bleaching cellulose pulp which is based on MW heating by the use of hydrogen peroxide ($H_2O_2$) and sodium hydroxide (NaOH) combination; see literature reference 11:

11) K. N. Law, S. G. Luo, J. L. Valade: Characteristics of Peroxide Bleaching of Microwave-Heated Thermomechanical Pulps, *J. Pulp Paper Sci.* 19 (1993) J181-J-186.

The removal of lignin and other side-products from the black liquor with the use of electrolytic reactor (cell) is known in the prior art. Typical example is technology disclosed by Edel and co-workers that is based on electrolysis of the black liquor with direct current (DC) between suitable electrodes. Lignin is released at the anode compartment, while at the cathode compartment sodium hydroxide is regenerated as the white liquor; see literature reference 12:

12) U.S. Pat. No. 4,584,076A; E. Edel, J. Feckl, C. Grambov, A. Huber, D. Wabner: Process for obtaining lignin from alkaline solutions thereof; applicant: MD Organically Zellst Umwelt Tec (DE).

Mikulic described a continuous process for cellulose pulp production from various grass-like feedstock, preferably *miscanthus* (*Miscanthus* x *giganteus*, Andersson), where:

(i) a mixture of NaOH (0.5-2.0% w/w) and NaCl (0.5-1.5% w/w) was employed as a cooking medium, at 70-120° C. during 1.5-3 h;

(ii) $H_2O_2$ (0.5-2.0% m/m) was used as bleaching agent in the presence of sodium silicate ($xNa_2O{\bullet}ySiO_2$; 0.5-2.0% w/w) at 70-100° C. during 45 min-1.5 h; where, (iii) the black liquor is processed by the electrolysis in a cell whose cathode and anode compartments are separated by a membrane; which is performed at:

(a) voltage from 3-30 V, preferably 3-10 V;

(b) current density from 1-10 A/dm$^2$, preferably 3-7 A/dm$^2$; and (c) temperature from 10-95° C.;

wherein at the cathode, aqueous sodium hydroxide (NaOH) with some residual sodium chloride (NaCl) is regenerated and hydrogen ($H_2$) is released, while at anode, liberation of oxygen ($O_2$) and lignin is taking place.

According to our best knowledge, this document represents the closest prior art to the present disclosure; see literature reference 13:

13) WO 2017/178849 A1; M. Mikulic: A Continuous Process for Production of Cellulose Pulp from Grass-like Feedstock; applicant: M. Mikulic.

In comparison to the process described in WO 2017/178849 A1, one embodiment of the present disclosure is based on:

(i) special system of serially-connected devices for:
  (a) cooking: primary digester mill (for milling/defibering) dewaterer (separator) secondary digester; and,
  (b) bleaching: primary bleaching reactor-mill (for milling/defibering) dewaterer (separator) secondary bleaching reactor;
  which enables quasi-continuous way of processing, and effective separation of the black liquor from the cooking phase and waste chemicals from the bleaching phase, as well as the addition of fresh chemicals for cooking and bleaching; this significantly enhances process efficiency under relatively mild reaction conditions and subsequently enables high degree of cellulose fibres preservation;

(ii) the bleaching process of brown cellulose with the mixture of white liquor which contains NaOH (0.5-2.0% w/w) and NaCl (0.5-25.0% w/w) and gaseous mixture of oxygen ($O_2$) and chlorine ($Cl_2$) at 70-100° C., which is generated at the anode compartment of the electrolytic cell; with, (iii) electrolytic removal of lignin from the black liquor of the cooking phase and waste liquid from bleaching phase, by the way that electrolytic cell contains electrolytic pre-cell, which does not contain a membrane between anode and cathode, what enhances efficacy of the electrolytic part of the process and minimizes the membrane clogging tendency within the electrolytic cell (7B), which is connected downstream in the process, after said electrolytic pre-cell (7B).

Said key improvements provide higher efficiency of the process and higher quality of the cellulose pulp for paper manufacturing from grass-like feedstock, as is described in the detailed description of the disclosure.

SUMMARY OF THE DISCLOSURE

The present disclosure includes a continuous process for production of cellulose pulp from grass-like feedstock by the use of electrolytic process for continuous isolation of lignin and other side-products, with simultaneous regeneration of the white liquor and oxygen ($O_2$) and chlorine ($Cl_2$), which is performed in an electrolytic cell which may include:

one or more electrolytic pre-cells; made from material inert to the chemistry of the process, in which cathode and anode electrodes are immersed, with no membrane between cathode and anode compartments;

one or more electrolytic cells; made from material inert to the chemistry of the process, in which cathode and anode electrodes are immersed, where cathode compartment is completely separated from anode compartment with porous membrane, which enables electrical contact of anode and cathode via ion-exchange, but prevents passing of suspended organic molecules in electrolyte;

where the electrolyte is, after processing in the pre-cells, transferred into anode compartment of electrolytic cells, and, if necessary, the composition of the electrolyte is modified during the course of the process by addition of a fresh sodium chloride (NaCl) solution into pre-cells;

where the production process may include the following steps:

A. preparation of a suspension of comminuted and dedusted grass-like feedstock by addition of a white liquor from cathode compartment of electrolytic cell into digester where the grass feedstock is subjected to cooking at 80-100° C. in solution of the white liquor of the following composition:
  (i) 0.50-2.00 w/w NaOH;
  (ii) NaCl;
  by keeping the concentration of grass feedstock at the level of 5-15% w/w, preferably 8-12% w/w dry matter, for preparation of step B;

B. quasi-continuous cooking and separation realized through two or more parallel lines [primary digester-mill-dewaterer-secondary digester] during 3-6 h, where the feedstock from the step A is prepared and sequentially pumped into two or more said parallel lines by the way that the output from all secondary digesters produces continuous process; where:
  the suspension of grass-like feedstock in the white liquor during cooking in all primary digesters and secondary digesters is maintained at temperature from 95-100° C.;
  brown cellulose suspension at the level 8-12% w/w dry matter at the output from every primary digester is subjected to milling in corresponding mills and separation in dewaterers from which a part of black liquor is transferred into the electrolytic pre-cell, while thus obtained concentrated suspension of brown cellulose with about 30% w/w dry matter enters into secondary digesters with introduction of the white liquor solution from the cathode compartment of the cells, that forms a suspension of approximately the same composition as is the suspension in digester of the step A;

C. quasi-continuous combined output from all secondary digesters with cooked brown cellulose suspension is transferred into a mixing vessel and a mill, while the separation of milled brown cellulose is performed in dewaterer which concentrates the brown cellulose suspension with 5-15% w/w dry matter up to the content of 27-33% dry matter, that is accompanied with separation of black liquor which is transferred to the pre-cell of the electrolytic cell, whilst the concentrated brown cellulose suspension is prepared for the step D;

D. preparation of a bleaching suspension is carried out in bleaching reactor in which, except the suspension from the step C,
  regenerated fresh white liquor from the cathode compartment of the electrolytic cell;
  mixture of oxygen ($O_2$) and chlorine ($Cl_2$) enveloped in the anode compartment of the electrolytic cell; and
  optionally, hydrogen peroxide ($H_2O_2$) or sodium peroxide ($Na_2O_2$), are introduced,
  yielding the bleaching suspension with the content of 5-15% w/w, preferably 10% w/w dry matter; and the preparatory bleaching process of brown cellulose from the step C is performed at 70-100° C. for the step E;

E. quasi-continuous bleaching process is realized through two or more parallel lines [primary reactor-mill-dewaterer-secondary reactor] during 3-6 h, at temperature from 70-100° C., where the feedstock from the step D is prepared and sequentially pumped into said two or more parallel lines in a way that the output from all secondary reactors makes a continuous process; where the primary bleaching process is performed in primary reactors and wherein at the output from the primary reactors, the suspension of bleached cellulose with 8-12% w/w dry matter, is obtained, which is subjected to milling in corresponding mills and separation in dewaterers from which, a part of waste-solution is transferred into the electrolytic pre-cell, while such concentrated bleached cellulose suspension with about 30% w/w dry matter is entering into secondary reactors with introduction of:

white liquor solution from the cathode compartment of the cells, mixture of oxygen ($O_2$) and chlorine ($Cl_2$) evolved in the anode compartment of the electrolytic cells; and optionally, hydrogen peroxide ($H_2O_2$) or sodium peroxide ($Na_2O_2$), yielding a bleached cellulose suspension with 8-12% w/w, preferably 10% w/w dry matter;

F. quasi-continuous combined output from all secondary bleaching reactors from the step E is transferred into a mixing vessel and dewaterer, whose waste water is returned back to the pre-cell of the electrolytic cell, while the drained cellulose comes out from the process in the form of a pure white cellulose pulp, at the concentration from 48-55% w/w dry matter, with maximally 5% w/w lignin, calculated on the dry matter.

A continuous process for cellulose pulp production from grass-like feedstock by the use of electrolytic process according to the present disclosure optionally includes further work-up of white cellulose from the step F, which involves further drying of viscous white cellulose suspension with 48-52% w/w dry matter, yielding dry cellulose powder.

Optionally, a key, electrolytic part of the continuous process for cellulose pulp production or dry cellulose powder from grass-like feedstock is performed under the following conditions:

cathode is made of carbon steel or rust-free steel, while for anode, graphite or magnetite is employed;

between the electrodes in the electrolytic pre-cell and electrodes in the electrolytic cell the voltage of direct current from 1.5-20 V, preferably from 3-6 V is established, at the current density from 1-10 A/dm$^2$, preferably from 4-6 A/dm$^2$, at the temperature of the cell from 80-95° C.;

the electrolysis in electrolytic pre-cell is carried out by introducing the black liquor from all lines of the step B, the black liquor from the step C, a part of waste solution from the step E, and waste water from the step F, wherein the evolution of lignin and other side-products takes place, which are mechanically removed from the top of the electrolyte solution; while, the electrolyte solution from the pre-cell is pumped into the anode compartment of the electrolytic cell for further processing wherein:

(i) at the cathode, the white liquor of the following composition is regenerated:

(a) 0.50-2.00% w/w sodium hydroxide (NaOH);

(b) sodium chloride (NaCl);

which is distributed into: digester in the step A; secondary digesters in the step B; in the bleaching reactor in the step C; and in the secondary bleaching reactors in the step D; and generated hydrogen is transferred into the corresponding storage tank;

(ii) at the anode, gaseous oxygen ($O_2$) and chlorine ($Cl_2$) are generated and subsequently introduced into the bleaching reactor in the step C and into the secondary bleaching reactors in the step E, and where the rest of lignin and other side-products are isolated and mechanically separated from the top of the electrolyte solution.

A membrane that physically separates cathode from anode compartment within the electrolytic cell is of a special importance. It may include material selected from the following group: asbestos, mineral wool, hydrated Portland cement, product of kaolin and sodium silicate, aluminium oxide ($Al_2O_3$), titanium dioxide ($TiO_2$), zirconium dioxide ($ZrO_2$), polyethylene (PE), polysulfone (PSU), polyvinyl pyrrolidone (PVP), polyvinyl chloride (PVC), polytetrafluoroethylene (PTFE), polyvinylidene fluoride (PVDF), sulfonated polytetrafluoroethylene (SPTFE), or composite materials obtained from the combinations of these materials.

Preferably, the membrane in the electrolytic cell is made of composite material including:

(i) zirconium dioxide ($ZrO_2$); from 80-90% w/w, preferably 85% w/w; and, (ii) polysulfone (PSU); from 10-20% w/w, preferably 15% w/w.

The working concentration of sodium chloride (NaCl) in the white liquor is from 0.50-25.0% w/w, preferably from 0.50-1.50% w/w. As the starting raw material in the present process, various grass-like feedstock can be employed, preferably sorghum (*Sorghum* species, Linne) and maize (*Zea mays*, Linne).

A. preparation of grass-like feedstock suspension for cooking;

B. quasi-continuous cooking of grass-like feedstock; and,

C. additional processing of brown cellulose.

Figure 2:
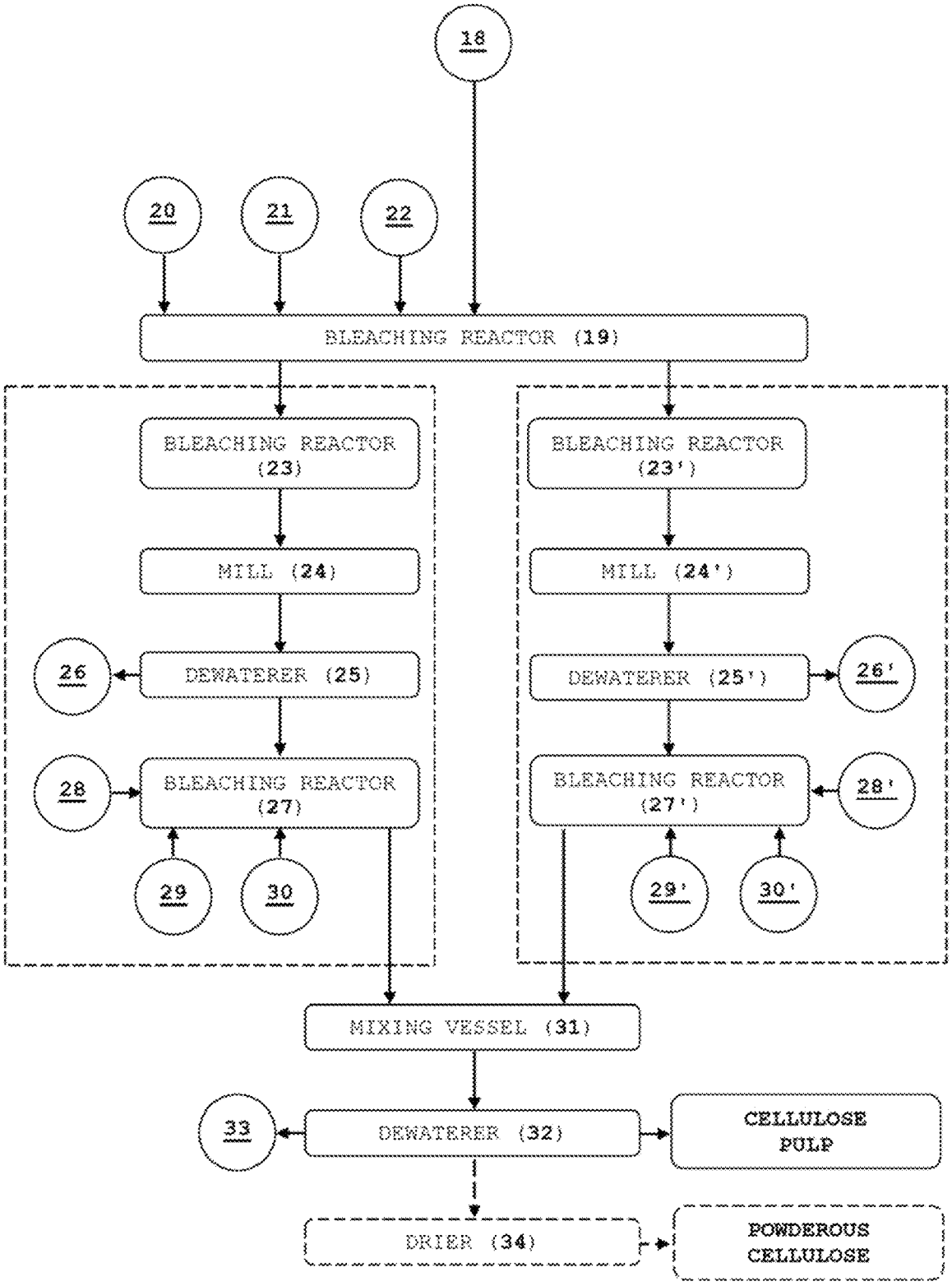

FIG. 2—shows a block diagram of continuous process for cellulose production which refers the following phases according to one embodiment of the present disclosure:

D. preparation of brown cellulose suspension for bleaching;

E. quasi-continuous bleaching of brown cellulose; and,

F. final processing of white cellulose.

Figure 3:
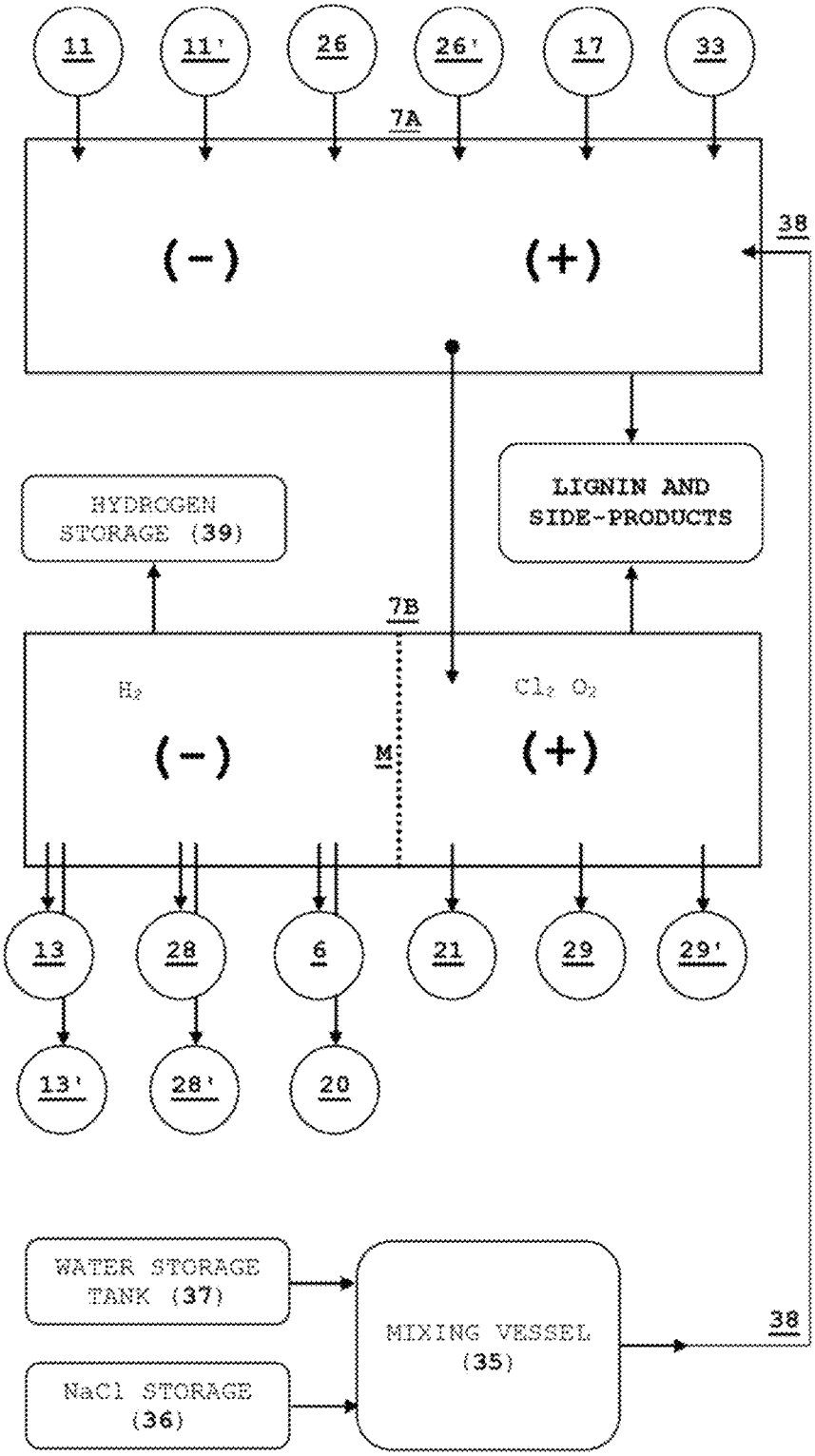

FIG. 3—shows a block diagram of continuous process for cellulose production which refers to the phase of electrolytic processing of the black liquor according to one embodiment of the present disclosure.

DETAILED DESCRIPTION OF THE DISCLOSURE

The present disclosure relates to the improved process for cellulose pulp production intended for paper manufacturing, from grass-like feedstock such as dried plant leaves or stems of sorghum (*Sorghum* species L.) or maize (*Zea mays* L.). Such feedstock typically contains 30-50% w/w cellulose, 18-30% w/w hemicellulose, and 5-20% w/w lignin; see literature references 14 and 15:

14) C. Ververis, K. Georghiou, N. Christodoulakis, P. Santas, R. Santas: Fiber dimensions, lignin and cellulose content of various plant materials and their suitability for paper production, *Industrial Crops Prod.* 19 (2004) 245-254.

15) B. Godin, F. Ghysel, R. Agneessens, T. Schmit, S. Gofflot, S. Lamaudière, G. Sinnaeve, J.-P. Goffart, P. A. Gerin, D. Stilmant, J. Delcarte: Détermination de la cellulose, des hémicelluloses, de la lignine et des cendres dans diverses cultures lignocellulosiques dédiées à la production de bioéthanol de deuxième génération, *Biotechnol. Agron. Soc. Environ.* 14 (2010) 549-560.

The present disclosure includes a continuous process for cellulose pulp production from grass-like feedstock by the use of electrolytic process for continuous electrolytic isolation of lignin and other side-products, with simultaneous production of the white liquor and oxygen ($O_2$) and chlorine ($Cl_2$), where the process may include the following steps:

A. preparation of grass-like feedstock suspension for cooking;

B. quasi-continuous cooking of grass-like feedstock;

C. additional processing of brown cellulose;

D. preparation of brown cellulose suspension for bleaching;

E. quasi-continuous bleaching of brown cellulose;

F. final processing of white cellulose; and,

G. electrolytic processing of black liquor.

These technological phases of the continuous process from the present disclosure include the following key details:

A. Preparation of Grass-Like Feedstock Suspension for Cooking

The preparation of the grass-like feedstock involves:

(i) an input of grass-like feedstock in the form of bales, which are introduced into the plant via conveyor (1), (ii) wherein said bales enter the bale cutter (2) where the bales are cut to roughly sized plant material, which subsequently goes to, (iii) the milling into the mill (3), which serves for cutting the grass-like feedstock up to the level of small particles, which are, (iv) dedusted in deduster (4) from impurities like dust, soil, natural silicates and so on.

As the starting grass-like feedstock in the process, dried leaves and/or stems of grass plant species are used, in the form of longitudinal pieces, whose length in minimally 90% fraction is from 0.2-2 cm. The moisture content in the starting grass feedstock is typically below 10% w/w, preferably below 5% w/w.

The prepared grass feedstock enters into the preliminary digester or digester (5), where the suspension for the cooking process is prepared.

In digester (5), the suspension of the grass-like feedstock is being formed from the white liquor, which is supplied by the pipeline (6) from the cathode compartment of the electrolytic cell (7B), and grass-like feedstock. The obtained suspension of grass-like feedstock may be of the following composition:

(a) 0.50-2.00% w/w sodium hydroxide (NaOH); and, (b) sodium chloride (NaCl);

with the concentration of grass-like feedstock at the level from 5-15% w/w, preferably 8-12% w/w dry matter, which is being cooked to 80-100° C. and then is ready for the step B.

The working concentration of sodium chloride (NaCl) in the white liquor is from 0.50-25.0% w/w, preferably from 0.50-1.50% w/w.

Figure 1:
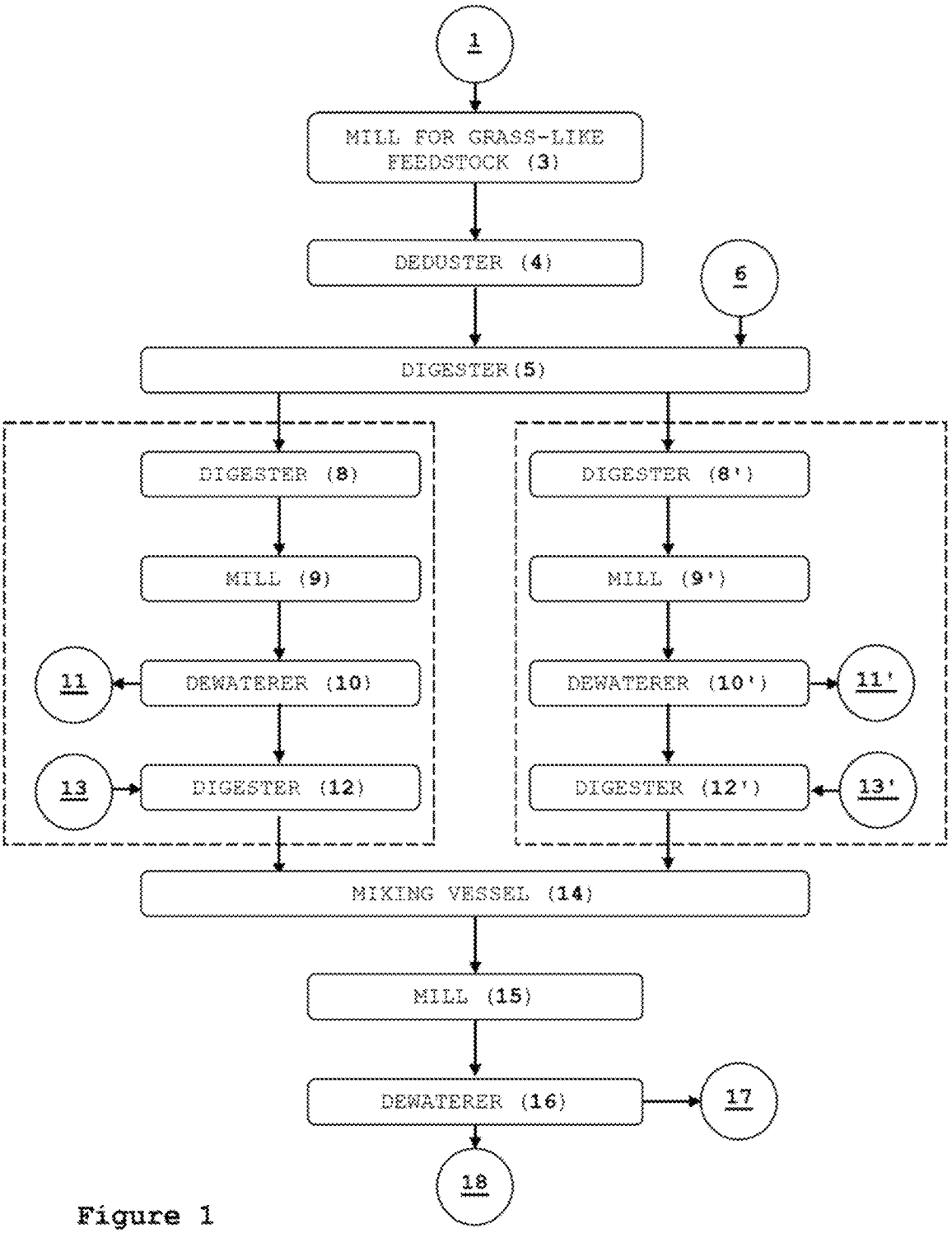
FIG. 1—shows a block diagram of continuous process for cellulose production which includes the following phases according to one embodiment of the present disclosure.

Schematic diagram of the grass-like feedstock suspension preparation for the cooking process is shown in FIG. 1.

B. Quasi-Continuous Cooking of Grass-Like Feedstock

Quasi-continuous cooking of grass-like feedstock and separation of waste black liquor is realized through two or more parallel lines, for example N lines, [primary digester (8, 8', . . . )-cooking mill (9, 9', . . . )-cooking dewaterer/separator (10, 10', . . . )-secondary digester (12, 12', . . . )] during 3-6 h, where the feedstock from the step A is prepared and sequentially pumped into said two or more parallel lines by the way that the output from all secondary digesters (12, 12', . . . ) produces a continuous process; where:

the suspension of grass-like feedstock in the white liquor during cooking in all primary digesters (8, 8', . . . ) and secondary digesters (12, 12' . . . ) is maintained at temperature from 95-100° C.;

the brown cellulose suspension, at the level from 8-12% w/w of dry matter, at the output from every primary digester (8, 8', . . . ) is subjected to milling/grinding in corresponding mills (9, 9', . . . ) and separation in dewaterers (10, 10', . . . ), from which a part of black liquor through manifold (11, 11', . . . ) is transferred into the electrolytic pre-cell (7A), while thus obtained concentrated suspension of brown cellulose containing about 30% w/w dry matter enters into secondary digesters (12, 12', . . . ), with introduction of the white liquor solution from the cathode compartment of the cells (7B) via manifold (13, 13', . . . ), what forms the suspension of approximately the same composition as is the suspension in digester (5) of the step A; where, the brown cellulose suspension in the fresh white liquor is additionally subjected to the cooking process in all secondary digesters (12, 12', . . . ) at temperature from 95-100° C.; while, after finishing the digesting process in every line of devices [primary digester (8, 8', . . . )-mill (9, 9', . . . )-dewaterer (10, 10', . . . )-secondary digester (12, 12', . . . )], the cooked brown cellulose suspension is alternately transferred into the mixing vessel (14).

In other words, the digesting phase of grass-like feedstock is performed by the way that the suspension prepared in the digester (5) is pumped and processed first in one of devices line [primary digester (8)-mill (9)-dewaterer (10)-secondary digester (12)], and then in the following alternative devices line [primary digester (8')-mill (9')-dewaterer (10')-secondary digester (12')]. The grass-like feedstock suspension in the white liquor during the digesting in digesters (8) and (12), or (8') and (12'), is maintained at temperature from 95-100° C. The number of parallel lines [primary digester-mill-dewaterer-secondary digester] can be arbitrary and is adjusted to achieve quasi-continuous process.

The brown cellulose suspension with about 10% w/w dry matter at the exit from the primary digesters (8, 8', . . . ) is subjected to milling/grinding in mills (9, 9', . . . ), and further processed in dewaterers (10, 10', . . . ) which are equipped with sieves of pores size 0.5-1.2 mm, in which certain part of the black liquor is separated by pressing. It contains lignin and other side-products, and is transferred through manifold (11, 11') into the pre-cell (7A) of the electrolytic cell (7). The concentrated brown cellulose suspension, with concentration at about 30% dry matter, is forwarded into the secondary digesters (12, 12', . . . ) in which the fresh solution of the white liquor is added via manifold (13, 13', . . . ) from the cathode compartment of the electrolytic cell (7B) forming the suspension of approximately the same composition as is the suspension in digester (5).

From the devices line [primary digester (8, 8', . . . )-mill (9, 9', . . . )-dewaterer (10, 10', . . . )-secondary digester (12, 12', . . . )] the cooked suspension of brown cellulose exits out into the mixing vessel (14). When the mixing vessel (14) is filled with the cooked cellulose suspension from the devices line [primary digester (8)-mill (9)-dewaterer (10)-secondary digester (12)], the content is immediately pumped into the mill (15). Once all content is emptied, then the cooked cellulose suspension from further devices line [primary digester (8')-mill (9')-dewaterer (10')-secondary digester (12')] is pumped into the mixing vessel (14), etc.—all in order to obtain apparently continuous process. During the course of the time of pumping the brown cellulose suspension from one devices line [primary digester (8")-mill (9")-dewaterer (10")-secondary digester (12")], the preparation of the starting suspension of grass-like feedstock is taking place in the digester (5) for another devices line [primary digester (8)-mill (9)-dewaterer (10)-secondary digester (12)]. By this way the process is carried out alternately between 1 . . . N devices lines, as explained herein in this short example of 1 . . . 3 parallel examples, and achieves quasi-continuous effect. As mentioned earlier, the minimal number of the devices lines for cooking is two.

Overall time for digesting the grass-like feedstock in the white liquor, which represents a retention time of one batch of the material in every of the devices line [primary digester (8, 8', . . . )-mill (9, 9', . . . )-dewaterer (10, 10', . . . )-secondary digester (12, 12', . . . )] is 3-6 h. The use of said devices line [primary digester (8, 8', . . . )-mill (9, 9', . . . )-dewaterer (10, 10', . . . )-secondary digester (12, 12', . . . )] enables the effect in which the raw uncooked grass-like feedstock cannot get into the mixing vessel (14), from which, the digested (cooked) brown cellulose suspension is pumped further into the mill (15).

Schematic diagram of quasi-continuous cooking of the grass-like feedstock suspension within the whole process is shown in FIG. 1, where the number of parallel lines is limited to minimally two.

C. Additional Processing of Brown Cellulose

Additional processing of the brown cellulose suspension after the digesting is carried out in a manner that quasi-continuous combined output from all secondary digesters (12, 12', . . . ) with cooked brown cellulose suspension is transferred into a first mixing vessel (14) and a first mill (15), where the milling of brown cellulose is performed and separation in a first dewaterer (16) takes place, where the brown cellulose suspension with 5-15% w/w dry matter concentrates up to the content of 27-33% dry matter, this process is accompanied with separation of the black liquor (17), which is transferred to the pre-cell (7A) of the electrolytic cell (7), whilst the concentrated brown cellulose suspension is prepared for the step D.

The term "quasi-continuous combined output" refers to the combined amount of all outputs of the brown cellulose suspension from every devices line for cooking [primary digester (8, 8', . . . )-mill (9, 9', . . . )-dewaterer (10, 10', . . . )-secondary digester (12, 12', . . . )], where, due to the alternating outputs of cooked brown cellulose suspension from each of devices line, the effect of continuous process is achieved. However, since this process is actually not really continuous, the fully correct term is "quasi"-continuous process. The combined output from all parallel devices lines [primary digester (8, 8', . . . )-mill (9, 9', . . . )-dewaterer (10, 10', . . . )-secondary digester (12, 12', . . . )] is the most precisely termed as "quasi-continuous combined output".

Schematic diagram of the additional processing of brown cellulose is shown in FIG. 1.

D. Preparation of Brown Cellulose Suspension for Bleaching

The preparation of the bleaching suspension is performed in bleaching reactor (19) in which, beside the suspension from the step C via pipeline (18):

- regenerated fresh white liquor from the cathode compartment of the electrolytic cell (7B) through pipeline (20);
- mixture of oxygen ($O_2$) and chlorine ($Cl_2$) enveloped in the anode compartment of the electrolytic cell (7B) through pipeline (21); and
- optionally, hydrogen peroxide ($H_2O_2$) or sodium peroxide ($Na_2O_2$) via pipeline (22), are introduced, giving the bleaching suspension with 5-15% w/w dry matter, preferably 10% w/w; and the preparatory bleaching process of brown cellulose from the step C is performed at 70-100° C. for the step E.

Preferably, the bleaching process is performed at temperature from 70-80° C.

As optional additional oxidants in the phase of brown cellulose bleaching, hydrogen peroxide ($H_2O_2$) or sodium peroxide ($Na_2O_2$) can be employed. As hydrogen peroxide source, typically commercially available $H_2O_2$ solution at about 30% w/w is used. In the case of $Na_2O_2$, it is clear that it yields an equimolar mixture of NaOH and $H_2O_2$, which is further used in the same manner as an additional oxidant in the bleaching process according to the present disclosure.

Schematic diagram of the phase of the preparation of brown cellulose suspension for bleaching process is shown in FIG. 2.

E. Quasi-Continuous Bleaching of Brown Cellulose

Quasi-continuous bleaching process is realized through two or more parallel lines [primary reactor (23, 23', . . . )-bleaching mill (24, 24', . . . )-bleaching dewaterer (25, 25', . . . )-secondary reactor (27, 27', . . . )] during 3-6 h, at temperature from 70-100 CC, preferably from 70-80° C., where the feedstock from the step D is prepared and sequentially pumped into said two or more parallel lines by the way that the output from all secondary reactors (27, 27', . . . ) produces a continuous process; where further bleaching process is performed in primary reactors (23, 23', . . . ) and where, at the output from the primary reactors (23, 23', . . . ), the suspension of bleached cellulose with 8-12% w/w dry matter is obtained, which is subjected to milling/grinding in corresponding mills (24, 24', . . . ) and separation in dewaterers (25, 25', . . . ) from which, a part of waste solution (26, 26', . . . ) is transferred through manifold (26, 26', . . . ) into the electrolytic pre-cell (7A), while the concentrated bleached cellulose suspension with about 30% w/w dry matter is entered into secondary reactors (27, 27', . . . ) with introduction of:

- white liquor solution (28) from the cathode compartment of the cells (7B) through manifold (28, 28', . . . ),
- mixture of oxygen ($O_2$) and chlorine ($Cl_2$) evolved in the anode compartment of the electrolytic cells (7B) via manifold (29, 29', . . . ); and,
- optionally, hydrogen peroxide ($H_2O_2$) or sodium peroxide ($Na_2O_2$) through pipeline (30, 30', . . . ), yielding the bleached cellulose suspension with 8-12% w/w, preferably 10% w/w dry matter.

In other words, the phase of quasi-continuous bleaching of the brown cellulose in the bleaching chemicals solution is performed by the way that the brown cellulose suspension is prepared in the bleaching reactor (19). It is then transferred into the devices line [primary bleaching reactor (23, 23', . . . )-mill (24, 24', . . . )-dewaterer (25, 25', . . . )-secondary bleaching reactor (27, 27', . . . )], in which the bleaching process in carried out at 70-100° C., preferably at 70-80° C. During the course of this process, brown cellulose is bleached with oxygen ($O_2$) and chlorine ($Cl_2$) in the presence of sodium hydroxide (NaOH; 0.5-2.0% w/w) and sodium chloride (NaCl; 0.5-25.0% w/w), furnishing the bleached cellulose suspension, which is subsequently continuously transferred into the mixing vessel (31).

After all amount of the starting brown cellulose suspension, that enters into the bleaching process, is transferred into the devices line [primary bleaching reactor (23)-mill (24)-dewaterer (25)-secondary bleaching reactor (27)], a new batch of brown cellulose suspension is preparing in the reactor (19), which is subsequently pumped into parallel devices line [primary bleaching reactor (23')-mill (24')-dewaterer (25')-secondary bleaching reactor (27')]. Once the bleaching of the batch in the devices line [primary bleaching reactor (23)-mill (24)-dewaterer (25)-secondary bleaching reactor (27)] is finished, then all the content from them is transferred through the mixing vessel (31) for further processing, in dewaterer (32). To the mixing vessel (31), further bleaching cellulose suspension from parallel devices line [primary bleaching reactor (23')-mill (24')-dewaterer (25')-secondary bleaching reactor (27')] is transferred. The number of such parallel lines should be optimal to achieve quasi-continuous manufacturing process.

The term "quasi-continuous bleaching" is used because it describes this bleaching process in the most precise manner. The bleaching in said parallel devices lines [primary bleaching reactor (23, 23', . . . )-mill (24, 24', . . . )-dewaterer (25, 25', . . . )-secondary bleaching reactor (27, 27', . . . )] by intermittent output of bleached cellulose from each of said devices line, gives the effect of continuous process. Due to the fact that it is not really a continuous bleaching process, it is the most precisely termed as "quasi-continuous bleaching".

As an oxidant for bleaching in the present disclosure, gaseous mixture of oxygen ($O_2$) and chlorine ($Cl_2$) is employed. The latter is generated electrolytically in anode compartment of the electrolytic cell (7B), which, in basic conditions (0.5-2.0% w/w NaOH) and under relatively mild reaction conditions, bleaches brown cellulose. Relative weight ratio of $O_2$ and $Cl_2$ in this mixture depends on weight percentage of sodium chloride (NaCl) in the white liquor, which can be from 0.5-25.0% w/w.

Schematic diagram of the phase of quasi-continuous bleaching of brown cellulose suspension is shown in FIG. 2.

F. Final Processing of White Cellulose

The final processing of the white cellulose is carried out in such a way that quasi-continuous combined output from all secondary bleaching reactors (27, 27', . . . ) from the step E is transferred into the second mixing vessel (31) and second dewaterer (32), where the draining of the waste chemicals-containing solution from the bleaching process is taking place, and said waste water is returned back to the pre-cell (7A) of the electrolytic cell (7) through pipeline (33), while the drained cellulose comes out from the process in the form of pure white cellulose pulp, at the concentration from 48-55% w/w dry matter, with maximally 5% w/w lignin, calculated on the dry matter.

Continuous process for cellulose pulp production from grass-like feedstock by the use of electrolytic process according to the present disclosure optionally includes further processing of the white cellulose from the step F., in a way that the viscous white cellulose suspension, at the level of 48-52% w/w dry matter, is further dried in drier (34), yielding dried cellulose powder.

The combined outputs of:

- the black liquor from the digesting phase, which is brought into the electrolytic cell (7) from dewaterer (10, 10', . . . ) through manifold (11, 11', . . . );
- residual black liquor which is separated from brown cellulose suspension after draining in dewaterer (16) via pipeline (17);
- waste water from the bleaching process which is separated in dewaterer (25, 25', . . . ) through manifold (26, 26', . . . ); and,
- waste water from the final processing of white cellulose from dewaterer (32) via pipeline (33);

are mixed together and transferred into the pre-cell (7A) of the electrolytic cell (7), where the electrolytic work-up of the black liquor is performed, phase G.

Schematic diagram of final processing of white cellulose is shown in FIG. 2.

G. Electrolytic Processing of Black Liquor

A key part of the continuous process for the production of the cellulose pulp or dry cellulose powder from grass-like feedstock according to one embodiment of the present disclosure is just said continuous electrolytic work-up of black liquor, which is carried out in electrolytic cell (7) including:

- one or more electrolytic pre-cell (7A); made from an inert material for the chemistry of the process, in which cathode and anode electrodes are immersed, with no membrane between cathode and anode compartments;
- one or more electrolytic cells (7B); made from an inert material for the chemistry of the process, in which cathode and anode electrodes are immersed, where cathode compartment is completely separated from anode compartment with porous membrane, which enables electrical contact of anode and cathode via ion-exchange, but prevents passing of suspended organic molecules in electrolyte;
- where the electrolyte is, after processing in the pre-cells (7A), transferred into anode compartment of electrolytic cells (7B), and, if necessary, the composition of the electrolyte is modified during the course of the process by addition of fresh sodium chloride (NaCl) solution into pre-cells (7A);
- cathode is made of carbon steel or rust-free steel (AISI 304, 316, 321 and others), while for anode, graphite or magnetite is employed; where,
- between the electrodes in the electrolytic pre-cell (7A) and electrodes in electrolytic cell (7B) the voltage of direct current from 1.5-20 V is established, at the current density from 1-10 A/dm$^2$, at the temperature of the cell from 80-95° C.; and,
- the electrolysis in the electrolytic pre-cell (7A) is carried out by introducing the black liquor (11, 11', . . . ) from the step B, the black liquor (17) from the step C, a part of waste solution (26, 26', . . . ) from the step E, and waste water (33) from the step F, wherein the evolution of lignin and other side-products takes place, which are mechanically removed from the top of the electrolyte solution; where,
- the electrolyte solution from the pre-cell (7A) is pumped into the anode compartment of the electrolytic cell (7B) for further processing wherein:

(i) at the cathode, the white liquor of the following composition is regenerated:
  (a) 0.50-2.00% w/w NaOH;
  (b) NaCl;
  which is distributed into:
    - digester (5) through pipeline (6) in the step A;
    - digesters (12, 12', . . . ) via manifold (13, 13', . . . ) in the step B;
    - bleaching reactor (19) through pipeline (20) in the step C; and,
    - bleaching reactors (27, 27', . . . ) via manifold (28, 28', . . . ) in the step D;
  and generated hydrogen is transferred into the storage tank for hydrogen (39);

(ii) at the anode, gaseous oxygen ($O_2$) and chlorine ($Cl_2$) are generated and subsequently introduced into:
  - bleaching reactor (19) through pipeline (21) in the step C; and,
  - bleaching reactors (27, 27', . . . ) via manifold (29, 29', . . . ) in the step E; and,
  - wherein the rest of lignin and other side-products are isolated and mechanically separated from the top of the electrolyte solution.

Preferably, the working voltage in the electrolytic cell is 3-6 V, while the current density is kept between 4-6 A/dm$^2$.

The membrane (M) that physically separates cathode from anode compartment within the electrolytic cell (7B) is of a special importance. It may include material selected from the following group: asbestos, mineral wool, hydrated Portland cement, product of kaolin and sodium silicate, aluminium oxide ($Al_2O_3$), titanium dioxide ($TiO_2$), zirconium dioxide ($ZrO_2$), polyethylene (PE), polysulfone (PSU), polyvinyl pyrrolidone (PVP), polyvinyl chloride (PVC), polytetrafluoroethylene (PTFE), polyvinylidene fluoride (PVDF), sulfonated polytetrafluoroethylene (SPTFE), or composite materials obtained from the combinations of these materials.

Preferably, the membrane (M) in the electrolytic cell (7B) is made of composite material including:

(i) zirconium dioxide ($ZrO_2$); from 80-90% w/w, preferably 85% w/w; and, (ii) polysulfone (PSU); from 10-20% w/w, preferably 15% w/w.

Material inert to the chemistry of the process from which is made electrolytic pre-cell (7A) and electrolytic cell (7B) is selected from the group consisting of: plastics such as polyvinyl chloride (PVC), polytetrafluoroethylene (PTFE), polyvinylidene fluoride (PVDF), polysulfone (PSU); or metals such as common steel, rust-free steels (AISI 304, 316, 321 and others) or aluminium, which are coated with coatings or linings resistant to chemicals involved in the process: polysulfone (PSU), polyvinyl pyrrolidone (PVP), polyvinyl chloride (PVC), polytetrafluoroethylene (PTFE), polyvinylidene fluoride (PVDF), sulfonated polytetrafluoroethylene (SPTFE), polychloroprene, their mixtures and other polymers.

The working concentration of sodium chloride (NaCl) in the white liquor is from 0.50-25.0% w/w, preferably from 0.50-1.50% w/w.

For necessary adjusting the content (weight percentage; % w/w) of sodium chloride (NaCl) in the white liquor for the cooking and bleaching processes, a fresh solution of sodium chloride (NaCl) is introduced through pipeline (38) into the anode compartment of electrolytic pre-cell (7A) within the electrolytic cell (7). This solution is prepared in mixing vessel (35) by addition of NaCl, which is stored in storage vessel (36), and purified water from storage tank (37).

Schematic diagram of electrolytic part of the whole process is shown in FIG. 3.

Equipment of Key Digesters and Bleaching Reactors

The digesters (5, 8, 8', . . . ; 12, 12', . . . ), bleaching reactors (19, 23, 23', . . . , 27, 27', . . . ) and mixing vessels (14, 31) are equipped with mixing elements which enable intensive stirring of suspended material at >900 revolutions per minute (r.p.m.).

The digesters (5, 12, 12', . . . ) and bleaching reactors (19, 27, 27', . . . ) are equipped with heating jackets which provide their heating to the working temperature.

Optionally, the digesters (5, 12, 12', . . . ) and bleaching reactors (19, 27, 27', . . . ) are, instead heating jackets, equipped with magnetrons for alternative heating via microwaves (MW). The microwave heating is a well-known in the prior art, see for instance literature reference 13), cited earlier.

Additionally, the digesters (5, 8, 8', . . . ; 12, 12', . . . ), bleaching reactors (19, 23, 23', . . . ; 27, 27', . . . ), and mixing vessels (14, 31) can be optionally equipped with vibrator, which generates 10,000-14,000 oscillations per minute, to facilitate the mixing; this manner is well-known in the prior art.

Starting Grass-Like Feedstock

As starting grass-like feedstock in the present process, dried leaves and/or stems of grass plant species in the form of longitudinal pieces can be used, whose fraction by length is minimally 90% between 0.2-2.0 cm.

The grass plant species are selected from the group consisting of: sorghum (*Sorghum* species, Linne); maize (*Zea mays*, Linne); *miscanthus* (*Miscanthus* x *giganteus*, Andersson(; sugar beet (*Saccharum officinarum*, Linne); wheat (*Triticum vulgare*, Linne); hemp (*Cannabis sativa*, Linne); barley (*Horedum vulgare*, Linne); oat (*Avena sativa*, Linne); common flax (*Linum usitatissimum*, Linne); proso millet (*Panicum miliaceum*, Linne) and other species from the genus *Panicum*; triticale (x *Triticosecale*, Wittm. ex A. Camus); buckwheat (*Fagopyrum esculentum*, Moench); rice (*Oryza sativa*, Linne); esparto grass (*Stipa tenacissima*, Linne and *Lygeum spartum*, Linne); reed (*Phragmites australis*, Adanson) and other species from the genus *Phragmites*; bagasse from sugarcane processing; jute (*Corchorus olitorius*, Linne); bamboo (*Bambusoideae* spp., Linne); and their mixtures.

Preferably, as the starting raw material in the present process, sorghum (*Sorghum* species, Linne) and maize (*Zea mays*, Linne) are used.

INDUSTRIAL APPLICABILITY

As is demonstrated in the detailed description, some embodiments of the present disclosure involve the continuous process for production of cellulose from grass-like feedstock, which is based on:

(i) a special system of serially-connected devices for:

(a) cooking: [primary digester (8, 8', . . . )-mill 9, 9', . . . )-dewaterer (10, 10', . . . )-secondary digester (12, 12', . . . )]; and, (b) bleaching: [primary bleaching reactor (19, 19', . . . )-mill (24, 24', . . . )-dewaterer (25, 25', . . . )-secondary bleaching reactor (27, 27', 27", . . . )];

which enables quasi-continuous way of processing, and effective separation of the black liquor from the cooking phase and waste chemicals from the bleaching phase, as well as the addition of fresh chemicals for cooking and bleaching; this significantly enhances efficiency of the process under relatively mild reaction conditions, which subsequently provide high degree of cellulose fibres preservation;

(ii) bleaching process of brown cellulose with electrolytically generated oxygen ($O_2$) in the presence of sodium hydroxide (NaOH; 0.5-2.0% w/w) and sodium chloride (NaCl; 0.5-25.0% w/w), which are generated in the electrolytic cell (7); and, (iii) electrolytic removal of lignin;

(a) from the black liquor of the cooking phase; and (b) waste liquid from bleaching phase;

in a way that electrolytic cell contains electrolytic pre-cell (7A), which does not contain the membrane between anode and cathode, what enhances efficacy of the electrolytic part of the process and minimizes tendency of clogging the membrane within the electrolytic cell (7B) which is connected downstream in the process from said electrolytic pre-cell (7A).

Said key improvements provide higher efficiency of the process and higher quality of the cellulose pulp for manufacturing of paper from the grass-like feedstock. This disclosure effectively solves all these three key issues identified in the technical problem. Therefore, the industrial applicability is unquestionable.

REFERENCES

1—conveyor for input of grass-like feedstock in the bales form
2—bales cutter
3—mill; for cutting the grass-like feedstock up to the level of fine comminuted parts
4—deduster
5—digester; for preparation of the suspension of comminuted grass feedstock in white liquor
6—pipeline; for entering white liquor from cathode compartment of the electrolytic cell (7B) into the digester (5)
7—electrolytic cell; a system of two or more serially-connected electrolytic cells
7A—electrolytic pre-cell unit; one or more serially-connected electrolytic cells without membrane (M)
7B—electrolytic cell: one or more serially-connected electrolytic cells with membrane (M)
8, 8'—primary digester
9,9'—mill; for milling/grinding of cellulose fibers
10,10'—dewaterer/separator; for removing of major part of black liquor from brown cellulose pulp suspension; elevates concentration of the dry matter in the suspension from 8-12% w/w to 27-33% w/w
11,11'—manifold; drains away part of black liquor from dewaterer (10) and (10') into electrolytic pre-cell (7A)
12,12'—secondary digester
13,13'—manifold; for delivery of white liquor from cathode compartment of electrolytic cell (7B) into digester (12) and (12')
14—mixing vessel
15—mill; for milling/grinding of cellulose fibres
16—dewaterer; for removing a part of black liquor from brown cellulose pulp suspension; elevates concentration of the dry matter in the suspension from 8-12% w/w to 27-33% w/w
17—pipeline; for separation of part of black liquor from dewaterer (16) into electrolytic pre-cell (7A)
18—pipeline; for transferring of concentrated brown cellulose suspension with about 30% w/w dry matter from dewaterer (16) into the bleaching reactor (19)
19—bleaching reactor
20—pipeline; for the white liquor supplying from cathode compartment of the electrolytic cell (7B) to the bleaching reactor (19)
21—pipeline; for delivery of gaseous oxygen ($O_2$) and chlorine ($Cl_2$) from anode compartment of the electrolytic cell (7B) to the bleaching reactor (19)
22—pipeline; for hydrogen peroxide ($H_2O_2$) solution or sodium peroxide ($Na_2O_2$) supply into the bleaching reactor (19)
23, 23'—primary bleaching reactor
24, 24'—mill
25, 25'—dewaterer
26, 26'—manifold; for removing waste water from bleaching process, from dewaterer (25) and (25') into electrolytic pre-cell (7A)
27, 27'—secondary bleaching reactor
28, 28'—manifold; for addition of the white liquor from cathode compartment of electrolytic cell (7B) to the bleaching reactor (27) or (27')
29, 29'—manifold; for transport of gaseous oxygen ($O_2$) and chlorine ($Cl_2$) from anode compartment of electrolytic cell (7B) into the bleaching reactor (27) and (27')
30, 30'—manifold; for hydrogen peroxide ($H_2O_2$) solution or sodium peroxide ($Na_2O_2$) supply into the bleaching reactor (27) and (27')
31—mixing vessel
32—dewaterer
33—pipeline; for removing waste solution from the bleaching process, from dewaterer (32) into the electrolytic pre-cell (7A)
34—drier
35—mixing vessel
36—storage vessel for sodium chloride (NaCl)
37—storage tank for water
38—pipeline; for optional addition of fresh aqueous sodium chloride (NaCl) solution into the electrolytic pre-cell (7A)
39—storage tank for hydrogen ($H_2$)
M—membrane; within electrolytic cell (7B), which physically separates cathode and anode compartment

The invention claimed is:

1. A continuous process, for production of cellulose pulp from a grass-like feedstock, that comprises an electrolytic process for continuous electrolytic separation of lignin and non-cellulosic side-products, with simultaneous production of white liquor and oxygen <$O_2$> and chlorine <$Cl_2$>, which is carried out in an electrolytic cell system which includes:

one or more electrolytic pre-cells, made from a first material inert to chemistry in which first cathode and anode electrodes are immersed, with no membrane between respective first cathode and anode compartments;

one or more electrolytic cells, made from a second material inert to chemistry in which second cathode and anode electrodes are immersed, where a second cathode compartment is completely separated from a second anode compartment with a porous membrane, which enables electrical contact of an anode and a cathode respectively associated with the second anode and cathode electrodes via ion-exchange, but prevents passing of suspended organic molecules in electrolyte;

where the electrolyte is, after processing in the one or more electrolytic pre-cells, transferred into the second anode compartment of the one or more electrolytic cells, and a composition of the electrolyte is modified by addition of a fresh sodium chloride (NaCl) solution into the one or more electrolytic pre-cells;

the continuous process comprises the following steps:

A) preparing a suspension of comminuted and dedusted grass-like feedstock by addition of a white liquor from the second cathode compartment of the one or more electrolytic cells into a preliminary digester where the grass-like feedstock is subjected to cooking at 80-100° C. in a solution of the white liquor including the following composition:

(ii) 0.50-2.00 w/w NaOH;

(ii) NaCl;

by keeping a concentration of the grass-like feedstock at a level of 5-15% w/w;

B) performing quasi-continuous cooking and separation through two or more parallel cooking and separation processing lines each including one or more primary digesters, one or more cooking mills, one or more cooking water separators, and one or more secondary digesters, during 3-6 hours, wherein the grass-like feedstock prepared in step A is sequentially pumped into the two or more parallel cooking and separation processing lines, wherein:

suspension of the grass-like feedstock in the white liquor during cooking in all of the one or more primary digesters and the one or more secondary digesters is maintained at temperature from 95-100° C.;

for each of the two or more parallel cooking and separation processing lines, a brown cellulose suspension at a level 8-12% w/w dry matter at an output from the one or more primary digesters is subjected to milling in the corresponding one or more cooking mills and separation in the one or more cooking water separators, from which a part of black liquor is transferred into the one or more electrolytic pre-cells, while a thus obtained concentrated suspension of brown cellulose with about 30% w/w dry matter enters into the one or more secondary digesters, with introduction of a white liquor solution from the second cathode compartment of the one or more electrolytic cells;

C) transferring a quasi-continuous combined output from all of the secondary digesters with the cooked brown cellulose suspension into a first mixing vessel and a first mill, where separation of milled brown cellulose is performed in a first water separator which concentrates the brown cellulose suspension with 5-15% w/w dry matter up to a content of 27-33% dry matter, and accompanied with separation of the black liquor which is transferred to the one or more electrolytic pre-cells;

D) preparing a bleaching suspension in a bleaching reactor, in which, besides the suspension from the step C:

regenerated fresh white liquor from the second cathode compartment of the electrolytic cells;

mixture of oxygen <02> and chlorine <C12> enveloped in the second anode compartment of the one or more electrolytic cells; and hydrogen peroxide <$H_2O_2$> or sodium peroxide <$Na_2O_2$>, are introduced, yielding the bleaching suspension with a content of 5-15% w/w, E) performing a quasi-continuous bleaching process through two or more parallel bleaching processing lines each including one or more primary reactors, one or more bleaching mills, one or more bleaching water separators, and one or more secondary reactors during 3-6 hours, at temperature from 70-100° C., where feedstock from the step D is prepared and sequentially pumped into said two or more parallel bleaching processing lines, where a primary bleaching process is performed in the one or more primary reactors and where, at the output from the one or more primary reactors, a suspension of bleached cellulose with 8-12% w/w dry matter is obtained, which is subjected to milling in the corresponding one or more bleaching mills and separation in the one or more bleaching water separators from which, a part of waste-solution is transferred into the one or more electrolytic pre-cells, while a concentrated bleached cellulose suspension with about 30% w/w dry matter is entering into the one or more secondary reactors with introduction of:

the white liquor solution from the second cathode compartment of the one or more electrolytic cells, the mixture of oxygen <$O_2$> and chlorine <$Cl_2$> enveloped in the second anode compartment of the one or more electrolytic cells; and the hydrogen peroxide <$H_2O_2$> or the sodium peroxide <$Na_2O_2$>, yielding the cellulose suspension for bleaching with 8-12% w/w; and F) transferring a quasi-continuous combined output from all of the one or more secondary bleaching reactors from the step E into a second mixing vessel and a second water separator, whose waste water is returned back to the one or more electrolytic pre-cells, while a drained cellulose comes out in a form of a pure white cellulose pulp, at a concentration from 48-55% W/W dry matter, with maximally 5% w/w lignin, calculated on the dry matter.

2. The continuous process according to claim 1, wherein the white cellulose pulp from the step F is further dried in a drier, yielding a dry cellulose powder.

3. The continuous process according to claim 1, wherein:

each of the first and second cathode electrodes is made of carbon steel or rust-free steel, and each of the first and second anode electrodes is made of graphite or magnetite;

between the first anode and cathode electrodes in the one or more electrolytic pre-cells and the second anode and cathode electrodes in the one or more electrolytic cells, a voltage of direct current from 1.5-20 V is established, at a current density from 1-10 A/dm$^2$, at a temperature of the cell from 80-95° C.;

the electrolysis in one or more electrolytic pre-cells is carried out by introducing the black liquor from the step B, the black liquor from the step C, a part of waste solution from the step E, and wastewater from the step F, wherein evolution of the lignin and the non-cellulosic side-products takes place, which are mechanically removed from a top of the electrolyte solution;

the electrolyte solution from the one or more electrolytic pre-cells is pumped into the second anode compartment of the one or more electrolytic cells for further processing wherein:

(i) at the cathode associated with the second cathode electrode, the white liquor of the following composition is regenerated:

(a) 0.50-2.00% w/w NaOH;

(b) NaCl;

which is distributed into: the preliminary digester in the step A; the one or more secondary digesters in the step B; the bleaching reactor in the step D; and the one or more secondary bleaching reactors in the step E; and generated hydrogen is transferred into a storage tank for hydrogen;

(ii) at the anode associated with the second anode electrode, gaseous oxygen <$O_2$> and chlorine <$Cl_2$> are generated and subsequently introduced into the bleaching reactor in the step D, and into the one or more secondary reactors in the step E; and wherein the rest of the lignin and the non-cellulosic side-products are isolated and mechanically separated from the top of the electrolyte solution.

4. The continuous process according to claim 1, wherein a concentration of the sodium chloride <NaCl> in the white liquor is 0.50-25.0% w/w.

5. The continuous process according to claim 4, wherein the concentration of the sodium chloride <NaCl> in the white liquor is 0.50-1.5% w/w.

6. The continuous process according to claim 1, where a starting, form of the grass-like feedstock is in the form of longitudinal pieces, whose fraction by length is minimally 90% between 0.2-2.0 cm, and comprises dried leaves and stems of grass plant species selected from the group consisting of: sorghum/*Sorghum* species, Linne/; maize/*Zea mays*, Linne/; *miscanthus/Miscanthus* x *giganteus*, Andersson/; sugar beet/Saccharum *officinarum*, Linne/; wheat/*Triti-*

*cuin vulgare*, Linne/; hemp/*Cannabis sativa*, Linne/; barley/*Horedum vulgare*, Linne/; oat/*Avena sativa*, Linne/; common flax/*Linum usitatissimum*, Linne/; proso millet/*Panicum millaceum*, Linne/and other species from the genus *Panicum; triticale/x Triticosecale*, Wittm. ex A. Camus/; buckwheat/*Fagopyrum esvulentum*, Moench/; rice/*Otyza* sativa, Linne/; esparto grass/*Stipa tenacissima*, Linne and *Lygeum spartum*, Linne/; reed/*Phragmites australis*, Adanson/and other species from the genus *Phragmites*; bagasse from sugarcane processing; jute/*Corchorus olitorius*, Linne/; bamboo/*Bambusoideae* spp., Linne/; and their mixtures.

7. The continuous process according to claim 6, wherein the starting form of the grass-like feedstock comprises sorghum/*Sorghum* species, Linne/and maize/*Zea mays*, Linne/.

8. The continuous process according to claim 1, wherein:

(i) the preliminary digester, the one or more primary digesters, the one or more secondary digesters, the bleaching reactor, the one or more primary reactors, the one or more secondary reactors, and the first and second mixing vessels are equipped with mixing elements which enable intensive stirring of suspended material at more than 900 revolutions per minute; and (ii) the preliminary digester, the one or more secondary digesters, the bleaching reactor, and the one or more secondary reactors are equipped with heating jackets which provide their heating to the working temperature.

9. The continuous process according to claim 6, wherein the preliminary digester, the one or more secondary digesters, the bleaching reactor, and the one or more secondary reactors are equipped with magnetrons for alternative heating via microwaves.

10. The continuous process according to claim 8, wherein:

(i) the preliminary digester, the one or more primary digesters, and the one or more secondary digesters, (ii) the bleaching reactor, the one or more primary reactors, and the one or more secondary reactors, and (iii) the first and second mixing vessels are additionally equipped with a vibrator to facilitate the mixing, and which generates 10,000-14,000 oscillations per minute.

11. The continuous process according to claim 1, wherein the quasi-continuous bleaching process is performed at temperature from 70-80° C.

12. The continuous process according to claim 3, wherein the electrolytic process for continuous electrolytic separation of the lignin and the non-cellulosic side-products and simultaneous regeneration of the white liquor is carried out at the voltage of direct current from 3-6 V and the current density from 4-6 A/dm$^2$.

13. The continuous process according to claim 1, wherein the porous membrane in the one or more electrolytic cells comprises at least a material selected from the group consisting of: asbestos, mineral wool, hydrated Portland cement, product of kaolin and sodium silicate, aluminium oxide <$Al_2O_3$>, titanium dioxide <$TiO_2$>, zirconium dioxide <$ZrO_2$>, polyethylene <PE>, polysulfone <PSU>, polyvinyl pyrrolidone <PVP>, polyvinyl chloride <PVC>, polytetrafluoro ethylene <PTFE>, polyvinylidene fluoride <PVDF>, sulfonated polytetrafluoroethylene <SPTFE>, and composite materials obtained from the combinations of these materials.

14. The continuous process according to claim 13, wherein the porous membrane in the one or more electrolytic cells comprises the material selected from:

zirconium dioxide <$ZrO_2$>; from 80-90% w/w, preferably 85% w/w; and, (ii) polysulfone <PSU>; from 10-20% w/w, preferably 15% w/w.

15. A process for production of cellulose pulp from a grass-like feedstock that comprises an electrolytic process which is carried out in an electrolytic cell system which includes:

one or more electrolytic pre-cells, made from a first material inert to the chemistry in which first cathode and anode electrodes are immersed, with no membrane between respective first cathode and anode compartments;

one or more electrolytic cells, made from a second material inert to the chemistry in which second cathode and anode electrodes are immersed, where a second cathode compartment is completely separated from a second anode compartment with a porous membrane, which enables electrical contact of an anode and a cathode respectively associated with the second anode and cathode electrodes via ion-exchange, but prevents passing of suspended organic molecules in electrolyte;

where the electrolyte is, after processing in the one or more electrolytic pre-cells, transferred into the second anode compartment of the one or more electrolytic cells, and a composition of the electrolyte is modified by addition of a fresh sodium chloride (NaCl) solution into the one or more electrolytic pre-cells;

the process comprising:

performing quasi-continuous cooking and separation through two or more parallel cooking and separation processing lines each including one or more primary digesters, one or more cooking mills, one or more cooking water separators, and one or more secondary digesters during 3-6 hours, wherein:

suspension of the grass-like feedstock in the white liquor during cooking in all of the one or more primary digesters and the one or more secondary digesters is maintained at temperature from 95-100° C.;

for each of the two or more parallel cooking and separation processing lines, a brown cellulose suspension at a level 8-12% w/w dry matter at output from the one or more primary digesters is subjected to milling in the corresponding one or more cooking mills and separation in the one or more cooking water separators, from which a part of black liquor is transferred into the one or more electrolytic pre-cells, while a thus obtained concentrated suspension of brown cellulose with about 30% w/w dry matter enters into the one or more secondary digesters, with introduction of a white liquor solution from the second cathode compartment of the one or more electrolytic cells;

performing a quasi-continuous bleaching process through two or more parallel bleaching processing lines each including one or more primary reactors, one or more bleaching mills, one or more bleaching water separators, and one or more secondary reactors during 3-6 h, at temperature from 70-100° C., wherein at an output from the one or more primary reactors, a suspension of bleached cellulose with 8-12% w/w dry matter is obtained, which is subjected to milling in the corresponding one or more bleaching mills and separation in the one or more bleaching water separators from which, a part of waste-solution is transferred into the one or more electrolytic pre-cells, while a concentrated bleached cellulose suspension with about 30% w/w dry matter enters the one or more secondary reactors with introduction of:

the white liquor solution from the second cathode compartment of the one or more electrolytic cells, the mixture of oxygen <$O_2$> and chlorine <$Cl_2$> enveloped in the second anode compartment of the one or more electrolytic cells; and yielding the cellulose suspension for bleaching with 8-12% w/w; and transferring a quasi-continuous combined output from all of the one or more secondary bleaching reactors into a second mixing vessel and a second water separator, whose waste water is returned back to the one or more electrolytic pre-cells, while a drained cellulose comes out in a form of a pure white cellulose pulp, at a concentration from 48-55% w/w dry matter, with maximally 5% w/w lignin, calculated on the dry matter.

16. The process according to claim 15, further comprising, before performing the quasi-continuous cooking and separation, preparing a suspension of comminuted and dedusted grass-like feedstock by addition of a white liquor from the second cathode compartment of the one or more electrolytic cells into a preliminary digester where the grass-like feedstock is subjected to cooking at 80-100° C. in the white liquor solution including the following composition:

(i) 0.50-2.00 w/w NaOH;

(ii) NaCl;

by keeping the concentration of the grass-like feedstock at the level of 5-15% w/w.

17. The process according to claim 16, further comprising, before performing the quasi-continuous bleaching process, transferring a quasi-continuous combined output from all of the one or more secondary digesters with the cooked brown cellulose suspension into a first mixing vessel and a first mill, wherein separation of milled brown cellulose is performed in a first water separator which concentrates the brown cellulose suspension with 5-15% w/w dry matter up to a content of 27-33% dry matter, and accompanied with separation of black liquor which is transferred to the pre-cell of the electrolytic cells; and preparing bleaching suspension in a bleaching reactor, in which, besides the suspension:

regenerated fresh white liquor from the second cathode compartment of the one or more electrolytic cells;

a mixture of oxygen <$O_2$> and chlorine <$Cl_2$> enveloped in the second anode compartment of the one or more electrolytic cells; and hydrogen peroxide <$H_2O_2$> or sodium peroxide <$Na_2O_2$>, are introduced, yielding the bleaching suspension with a content of 5-15% w/w.

18. The process according to claim 15, wherein:

each of the first and second cathode electrodes is made of carbon steel or rust-free steel, and each of the first and second anode electrodes is made of graphite or magnetite;

between the first anode and cathode electrodes in the in the one or more electrolytic pre-cells and the second anode and cathode electrodes in the one or more electrolytic cells, a voltage of direct current from 1.5-20 V is established, at a current density from 1-10 A/dm$^2$, at a temperature of the cell from 80-95° C.;

the electrolysis in the one or more electrolytic pre-cells is carried out by introducing the black liquor and the wastewater into the one or more electrolytic pre-cells where evolution of lignin and non-cellulosic side-products takes place, which are mechanically removed from a top of the electrolyte solution;

the electrolyte solution from the one or more pre-cells is pumped into the second anode compartment of the one or more electrolytic cells for further processing wherein:

(i) at the cathode associated with the second cathode electrode, the white liquor of the following composition is regenerated:

(a) 0.50-2.00% w/w NaOH;

(b) NaCl;

which is distributed into: the preliminary digester; the one or more secondary digesters; the bleaching reactor; and the one or more secondary bleaching reactors; and generated hydrogen is transferred into a storage tank for hydrogen;

(ii) at the anode associated with the second anode electrode, gaseous oxygen <$O_2$> and chlorine <$Cl_2$> are generated and subsequently introduced into the bleaching reactor and the one or more secondary reactors; wherein the rest of the lignin and non-cellulosic side-products are isolated and mechanically separated from the top of the electrolyte solution.

19. The process according to claim 15, wherein a concentration of sodium the chloride <NaCl> in the white liquor is 0.50-25.0% w/w.

20. The process according to claim 15, where a starting form of the grass-like feedstock is in a form of longitudinal pieces, whose fraction by length is minimally 90% between 0.2-2.0 cm, and comprises dried leaves and stems of plant species selected from the group consisting of sorghum/*Sorghum* species, Linne/; maize/*Zea mays*, Linne/; *miscanthus/Miscanthus* x *giganteus*, Andersson/; sugar beet/*Saccharum officinarum*, Linne/; wheat/*Triticum vulgare*, Linne/; hemp/*Cannabis sativa*, Linne/; barley/*Horedum vulgare*, Linne/; oat/*Avena sativa*, Linne/; common flax/*Linum usitatissimum*, Linne/; proso millet/*Panicum miliaceum*, Linne/and other species from the genus *Panicum*; triticale/x *Triticosecale*, Wittm. ex A. Camus/; buckwheat/*Fagopyrum esculentum*, Moench/; rice/*Oryza sativa*, Linne/; esparto grass/*Stipa tenacissima*, Linne and *Lygeum spartum*, Linne/; reed /*Phragmites australis*, Adanson/and other species from the genus *Phragmites*; bagasse from sugarcane processing; jute/*Corchorus olitorius*, Linne/; bamboo/*Bambusoideae* spp., Linne/; and their mixtures.

* * * * *